US008733803B2

(12) United States Patent
Drumm

(10) Patent No.: US 8,733,803 B2
(45) Date of Patent: May 27, 2014

(54) FASTENER FOR A TRANSPORT CONTAINER

(75) Inventor: Martin Drumm, München (DE)

(73) Assignee: Adam Hall GmbH, Neu-Anspach (DE)

( * ) Notice: Subject to any disclaimer, the term of this patent is extended or adjusted under 35 U.S.C. 154(b) by 0 days.

(21) Appl. No.: 13/364,701

(22) Filed: Feb. 2, 2012

(65) Prior Publication Data

US 2013/0026769 A1 Jan. 31, 2013

Related U.S. Application Data

(62) Division of application No. 11/728,496, filed on Mar. 26, 2007, now abandoned.

(30) Foreign Application Priority Data

Mar. 27, 2006 (DE) ..... 10 2006 014 431
May 31, 2006 (DE) ..... 10 2006 025 266

(51) Int. Cl.
*E05C 5/00* (2006.01)

(52) U.S. Cl.
USPC ..... 292/114; 292/170; 292/152

(58) Field of Classification Search
USPC ..... 292/114, 170, 152
See application file for complete search history.

(56) References Cited

U.S. PATENT DOCUMENTS

| | | | | |
|---|---|---|---|---|
| 1,126,836 | A | 2/1915 | Newton | |
| 2,853,752 | A * | 9/1958 | Schlueter | 403/182 |
| 4,522,436 | A | 6/1985 | Hoen et al. | |
| 4,758,031 | A | 7/1988 | Wolf | |
| 4,958,865 | A | 9/1990 | Cheng | |
| 5,511,834 | A * | 4/1996 | Willems | 292/203 |
| 5,797,635 | A | 8/1998 | Willems | |
| 6,357,803 | B1 * | 3/2002 | Lorek | 292/99 |

FOREIGN PATENT DOCUMENTS

DE 198 04 582 A1 9/1998

OTHER PUBLICATIONS

Apr. 13, 2001 Extended European Search Report for Application No. EP 07 00 6310.

* cited by examiner

*Primary Examiner* — Mark Williams
(74) *Attorney, Agent, or Firm* — Howard & Howard Attorneys PLLC

(57) ABSTRACT

A fastener for a transport container includes two portions to be connected and wherein the fastener includes a fastener flange arranged in a first cup and a displaceable fastener hook tiltably arranged in a second cup, the hook engaging behind the fastener flange in a closed position, it is provided in that at least one spring is disposed such that the fastener hook is pushed toward the bottom of the second cup into a rest position.

18 Claims, 7 Drawing Sheets

FASTENER FOR A TRANSPORT CONTAINER

CROSS-REFERENCE TO RELATED APPLICATION(S)

The present application is a divisional application of U.S. Ser. No. 11/728,496, filed Mar. 26, 2007 now abandoned.

BACKGROUND OF THE INVENTION

1. Field of the Invention

The present invention relates generally to fasteners and, more specifically, to a fastener for a transport container.

2. Description of the Related Art

Fasteners that are referred to as butterfly fasteners have been known for a while, e.g. by U.S. Pat. No. 3,516,125. Such kinds of fasteners are often used in transport containers for instruments and equipment, which can be stacked in transportation mechanisms, such as airplanes and trucks. For protecting the fasteners, the fasteners are designed such that a locking mechanism does not protrude beyond the surface of the transport container by using cups, at least in the locked state.

However, it has turned out that a protrusion of the locking mechanism beyond the surface is also disadvantageous in the unlocked state, e.g. implies a danger of accident. In order to eliminate the disadvantage, a fastener known from U.S. Pat. No. 5,511,834 limits the outward motion of a fastener hook, which is effected by a spring, by means of appropriate constructive measures. Therewith, these disadvantages of the butterfly fasteners known up to then could be avoided only insufficiently.

SUMMARY OF THE INVENTION

The inventive fastener is characterized in that at least one spring is arranged such that the fastener hook is pushed toward the bottom of the second cup into a rest position. Therewith, it is guaranteed that the fastener hook and the parts connected therewith are pushed into the cup by the spring in an opened position as well as in a locked position.

In order to avoid that the fastener hook has to be pulled outward when releasing the fastener, at least one further spring is provided in an advantageous embodiment, the force action of which is directed such that the fastener hook may engage behind the fastener flange (edge) only when pressure is applied from outside.

In order to avoid that the fastener hook must be lifted to reach the fastener flange in case of a displacement of the fastener hook, it is provided according to a further embodiment that a bevel is arranged in the first cup, the bevel guiding the fastener hook upon a displacement toward the fastener flange from the rest position to the fastener flange.

This object may alternatively or additionally also be achieved in that the fastener hook is provided with a bevel guiding the fastener hook upon a displacement toward the fastener flange from the rest position to the fastener flange.

An advantageous embodiment of the present invention provides that the fastener flange is part of an opening of a fastener housing. Therein, it is preferably provided that the opening is closed by a further spring which releases the opening upon pressure from outside.

In this embodiment, it may further be provided that the force of the further spring is larger than the force applied by the fastener hook to the further spring by the effect of the spring.

An advantageous development of this embodiment consists in that the second spring is a plate spring having an embossment in the region of the opening of the fastener housing. Therewith, the opening is closed in the opened or unlocked state and, in addition, a displacement of the fastener hook is possible without any further measures, e.g. without lifting the fastener hook, when opening.

Another advantageous embodiment consists in that the further spring is arranged at the fastener hook such that it closes the fastener hook in its rest position.

In the known butterfly fasteners, the displacement of the fastener hook is performed by an eccentric (cam) being pivotable by a wing handle. In order to further reduce a protrusion of parts of the fastener in the inventive fastener, it is provided according to a further development that a bolt serving to displace the fastener hook through an eccentric is pivotable by a wing handle and that pins engaging into recesses in the bolt are formed at portions of the wing handle, the portions being bevelled substantially by 90°.

A further embodiment of the inventive fastener is characterized in that at least one spring is arranged such that the fastener hook is pushed toward the bottom of the second cup into a rest position, and that a lifter positioned below the fastener hook co-operates with am embossment at the bottom of the second cup such that the fastener hook is lifted from its locked position for opening the fastener and is lowered into the locked position for closing the same.

In an embodiment of the invention, it is provided that the lifter is a further eccentric being pivotable by the bolt. The embodiment may be formed in that a further eccentric has the shape of a spherical calotte.

In a further embodiment, it is provided that the lifter is arranged at the fastener hook. The embodiment may be formed in a particularly simple manner such that the lifter is formed by a chamfering of the hook fastener.

An advantageous embodiment of the present invention consists in that the fastener flange is part of an opening of a fastener housing.

An advantageous embodiment which may be manufactured at low costs consists in that the embossment at the bottom of the second cup is a stamping.

Other objects, features, and advantages of the presents invention will be readily appreciated, as the same becomes better understood, after reading the subsequent description taken in conjunction with the accompanying drawings.

BRIEF DESCRIPTION OF THE DRAWINGS

Embodiments of the invention are shown in the drawings in several figures and described in more detail in the following description. In the figures.

DESCRIPTION OF THE PREFERRED EMBODIMENT(S)

Figure 1:
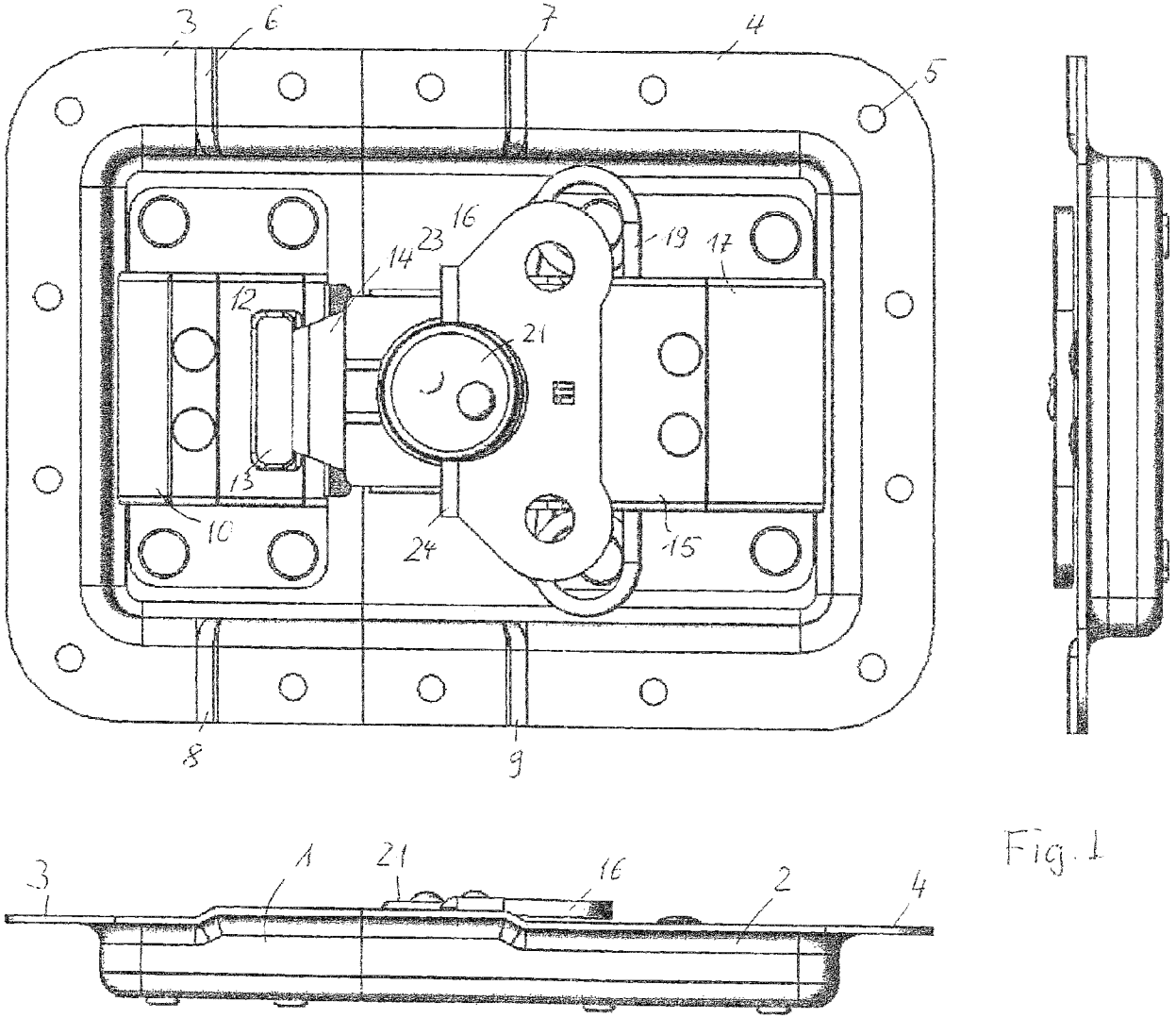
FIG. 1 shows three views of an embodiment, according to the present invention.

Referring now to the drawings, and in particular FIG. 1, one embodiment of a fastener for a transport container, according to the present invention, is shown. A first cup 1 and a second cup 2 serve to receive the fastener, wherein the cups may be installed countersunk in the two parts of the container to be locked (cover and container). For this purpose, a flange 3, 4 having respective holes for riveting or screwing is provided. The edges 3, 4 at 6, 7, 8, 9 are cramped to adapt to the edge reinforcements of the container and the cover. The cup 1 supports a fastener housing 10 in which a plate spring 11 is located which closes an opening 12 in the unlocked state (FIGS. 2 and 3) and is therefore provided with a corresponding embossment 13A. The fastener housing 10 is provided with a bevel 10' which lifts the fastener hook 14 upon closing the transport container.

The fastener hook 14 is movably supported in the longitudinal direction in a guiding 15. To move or displace the fastener hook 14, a bolt or nut 21 is used, the bolt acting on the fastener hook through an eccentric which is not shown in more detail. By turning a wing handle 16, the fastener hook 14 may be displaced (made shorter or longer). The guiding 15 is tiltably supported in a further housing 17 which is mounted on the bottom of the second cup 2, wherein a plate spring 18 (FIGS. 2 to 4) presses the guiding and thus the fastener hook toward the bottom of the cup 2.

A wire spring 19 serves as an axis for the tiltable guiding 15 and is supported in elongate holes (not shown) in the housing 17, while the ends of the wire spring are fixed. Therewith, a defined force is applied between the two cups 1, 2 upon locking the fastener, i.e. upon pulling the fastener hook 1.

Figure 2:
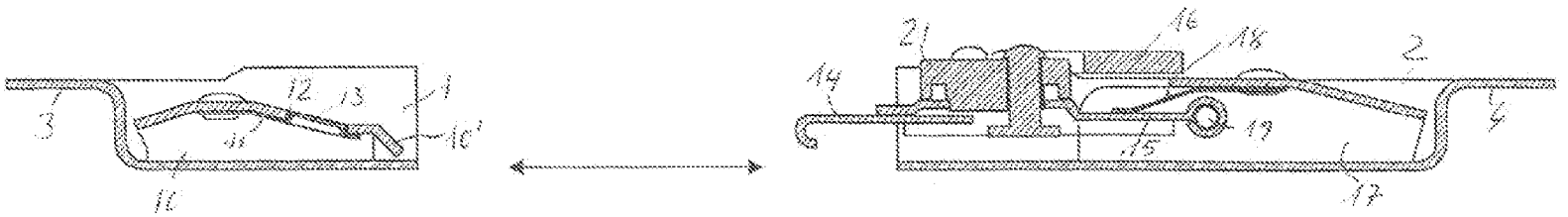
FIG. 2 shows a longitudinal section in the open position of the not shown transport container.
Figure 3:
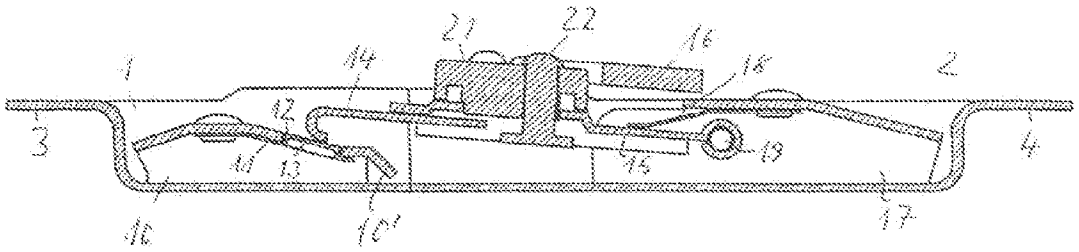
FIG. 3 shows the longitudinal section in the closed position of the transport container during the locking process.
Figure 4:
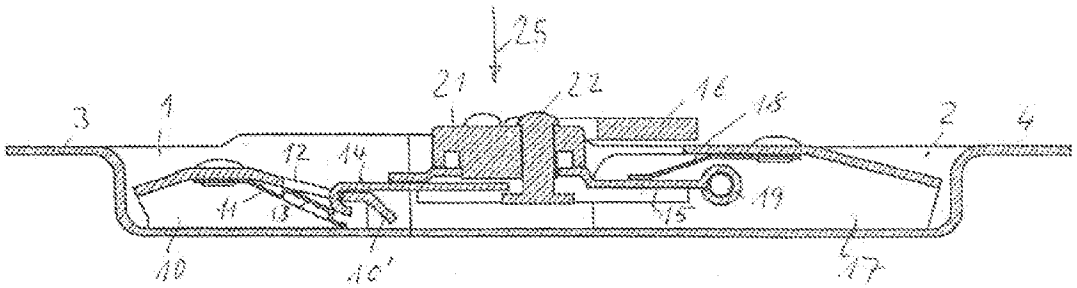
FIG. 4 shows the locked fastener.

FIG. 2 shows the two parts of the fastener separated from one another, as is the case in the opened transport container. In FIG. 3, the two parts of the transport container are pushed together, such that the fastener hook slides across a bevel 20 onto the fastener housing 10. Since the plate spring 11 applies a stronger force on the fastener hook than the spring 18, a force must be applied on the fastener hook 14 in direction of the arrow 25 for closing and locking same. Therewith, the fastener hook is pushed into the opening 12 (See FIG. 4) whereupon the fastener hook 14 is tensioned against the effect of the wire spring 19 by turning the wing handle 16. The movement of the fastener hook 14 is obtained by the pivotable bolt 21 at which a pin 22 is eccentrically arranged, the pin engaging into a corresponding recess of the guiding 15.

Cams are formed at the wing handle 16 in rectangular bent portions 23, 24, the cams engaging into corresponding recesses in the bolt 21. The cams are square-shaped and are loaded by a disc spring (not shown) such that the wing handle 16 engages in the shown flat position or in a position facing upwards.

Figure 5:
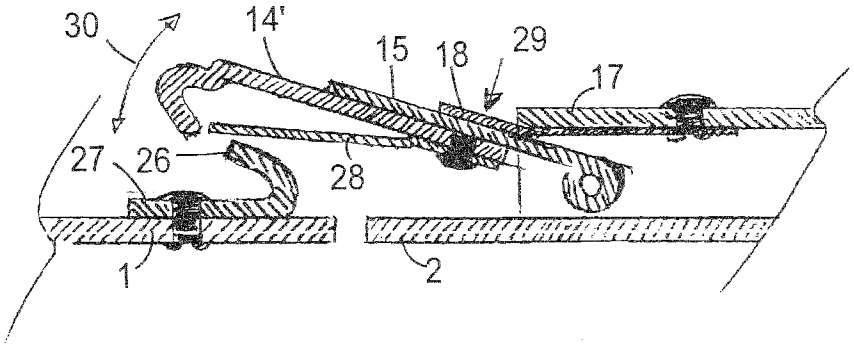
FIG. 5 shows parts of a further embodiment.

FIG. 5 shows parts of a further embodiment in which a fastener hook 14' being tiltable in direction of the double arrow 30 engages behind a fastener flange 26 in the closed position, the flange being formed by a rail 27 arranged at the cup 1. As in the first embodiment, a plate spring 18 is provided to push the guiding 15 and thus the fastener hook 14' downward. A further plate spring 28 prevents closing of the fastener before pressure is exerted on the guiding 15 in direction of the arrow 29.

Figure 6:
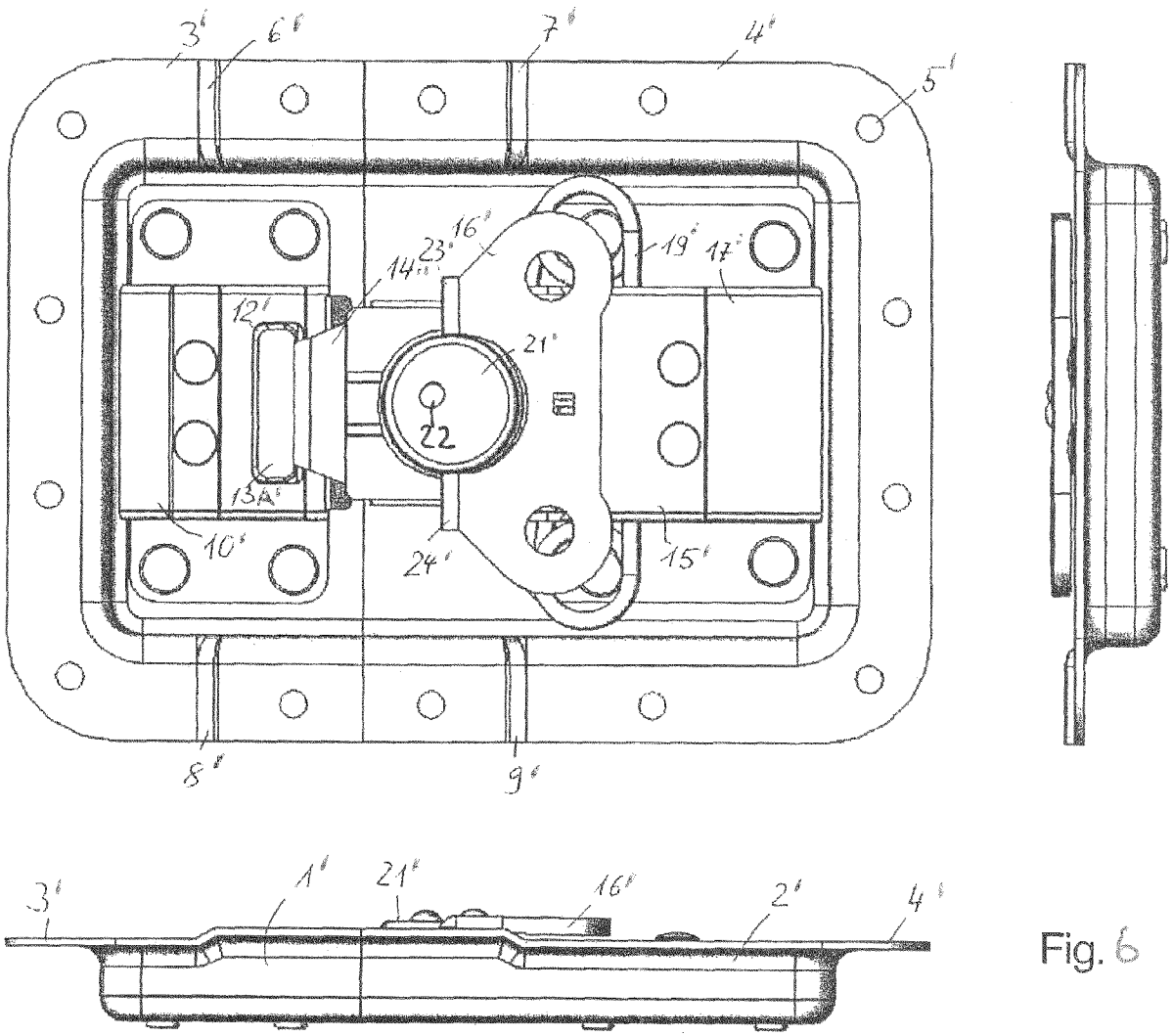
FIG. 6 shows three views of a further embodiment.

According to FIG. 6, a first cup 1' and a second cup 2' serve to receive the fastener, wherein the cups may be installed countersunk in the two parts of the container to be locked (cover and container). For this purpose, a flange 3', 4' having respective holes for riveting or screwing is provided. The flanges 3', 4' at 6', 7', 8', 9' are cramped to adapt to the locking profiles of the container and the cover. The cup 1' supports a fastener housing 10' with an opening 12'.

The fastener hook 14" is movably supported in the longitudinal direction in a guiding 15'. To move or displace the fastener hook 14", a bolt or nut 21' is used, the bolt acting on the fastener hook through an eccentric which is not shown in more detail. By turning a wing handle 16', the fastener hook 14" may be displaced (made shorter or longer). The guiding 15' is tiltably supported in a further housing 17' which is mounted on the bottom of the second cup 2', wherein a plate spring 18' presses the guiding and thus the fastener hook toward the bottom of the cup 2'.

A wire spring 19' serves as an axis for the tiltable guiding 15' and is supported in elongate holes (not shown) in the housing 17', while the ends of the wire spring are fixed. Therewith, a defined force is applied between the two cups 1', 2' upon locking the fastener, i.e. upon pulling the fastener hook 14', despite existing tolerances.

FIG. 7*a* shows the two parts of the fastener spaced from each other, as is the case when the transport container is open. In FIG. 7*b*, the two parts of the transport container are pushed together, wherein the fastener hook 14" lies above the opening 12'. This is effected in that, by a rotation of the bolt 21, a calotte-shaped eccentric 13' tapers off on an embossment 11' at the bottom of the second cup 2'. Upon this rotation (FIG. 7*b*), the fastener hook 14" is additionally pushed forward so far that it may engage into the opening 12' in the subsequent locking process (FIG. 7*c*).

By a rotation in the opposite direction, the fastener hook 14" is pushed into the opening 12' (See FIG. 7*c*), whereupon the fastener hook 14" is tensioned against the effect of the wire spring 19' by a further rotation of the wing handle 16'. This movement of the fastener hook 14' is performed by a pin 22' being eccentrically attached to the pivotable bolt 21'.

Cams are formed at the wing handle 16' in rectangular bent portions 23', 24', the cams engaging into corresponding recesses in the bolt 21'. The cams are square-shaped and are loaded by a disc spring (not shown) such that the wing handle 16' engages in the shown flat position or in a position facing upwards.

Figure 7:
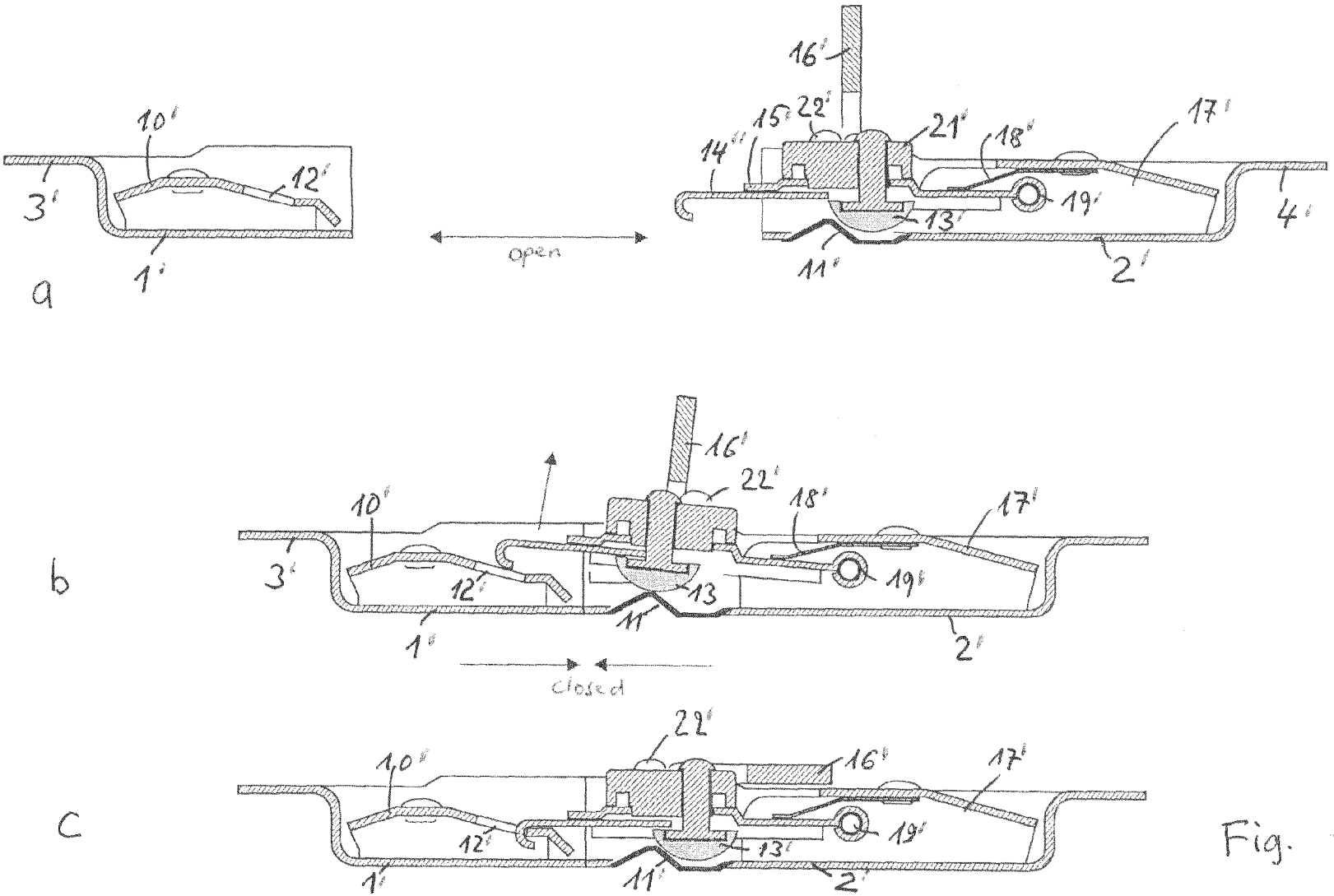
FIG. 7 *a-c* show a longitudinal section through a further embodiment in the open position of the not shown transport container, the longitudinal section of a closed position of the transport container with released fastener and with locked fastener, FIG. 8*a-d*3 show different positions of the wing handle and the fastener hook of the further embodiment when opening same.
Figure 8:
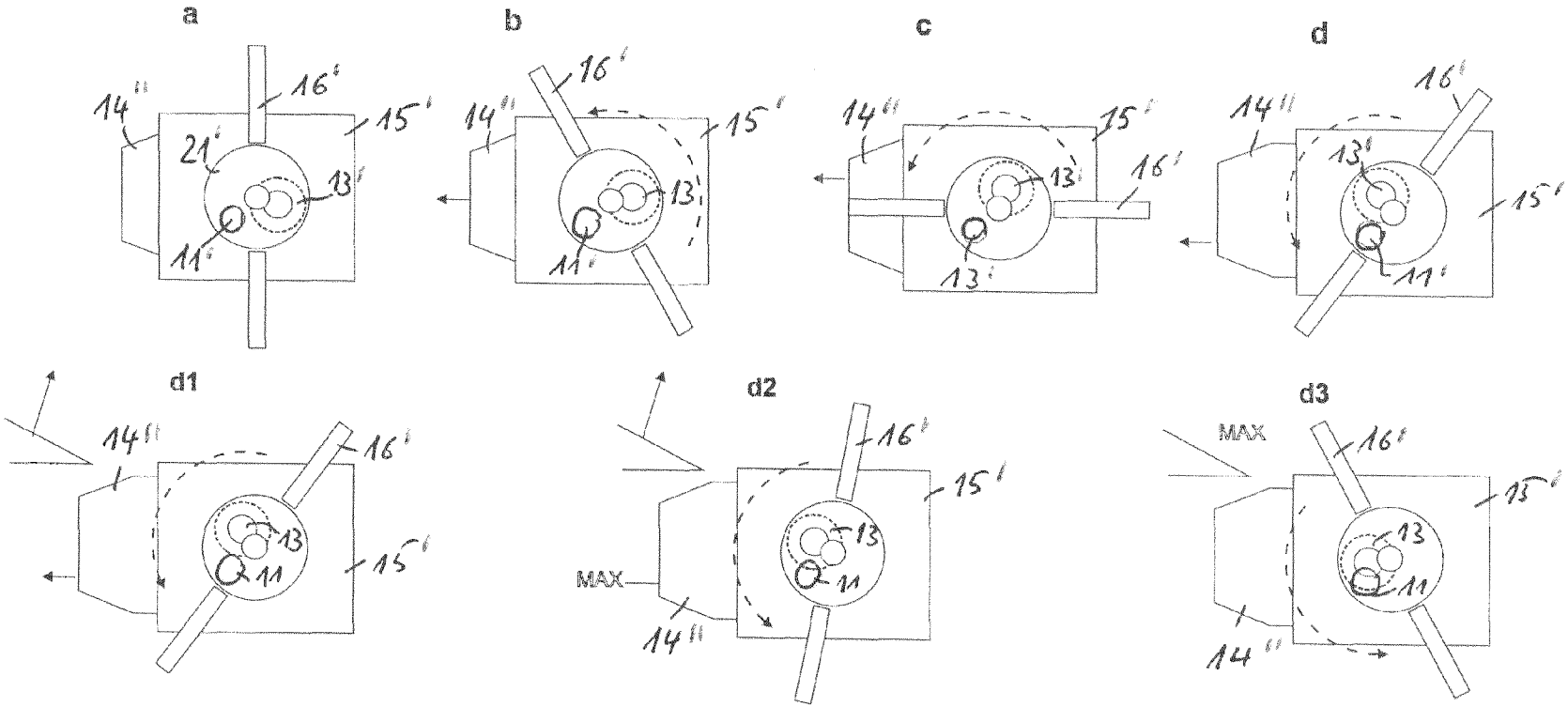

FIGS. 8*a* to 8*d*3 show parts of the embodiment according to FIGS. 6 and 7 in several phases of the movement upon opening the fastener. The parts spherical calotte 13', embossment 11' at the bottom of the second cup and the pivotal point of the bolt 21', which are not visible in the plan view, are shown as circles. FIG. 8*a* shows the zero position when the fastener is closed, wherein the fastener hook 14" only protrudes a little from the guiding 15'.

FIGS. 8*b* and 8*c* show different positions during the process of opening, wherein the fastener hook 14" leaves the guiding 15'. In the position shown in FIG. 8*d*, the fastener hook protrudes by 95%. In FIG. 8*d*1, the spherical calotte 13' starts to move toward the embossment 11' whereupon the fastener hook 14" starts with its upward motion, the motion ranging from the position shown in FIG. 8*d*2 to the final position shown in FIG. 8*d*3. In this position, the cover of the transport container can be lifted. When closing, the sequence of motions is performed in the inverse direction, i.e. first moving upwards and then closing.

FIGS. 9*a* to 9*c* show an another embodiment—for the sake of simplicity without the wing handle—in which the lifting of the fastener hook 14''' is effected by means of an upstand 31 at the fastener hook 14''', the upstand co-operating with an embossment 11" at the bottom of the second cup 2' upon moving the fastener hook 14''' out of the guiding 15'.

Figure 9:
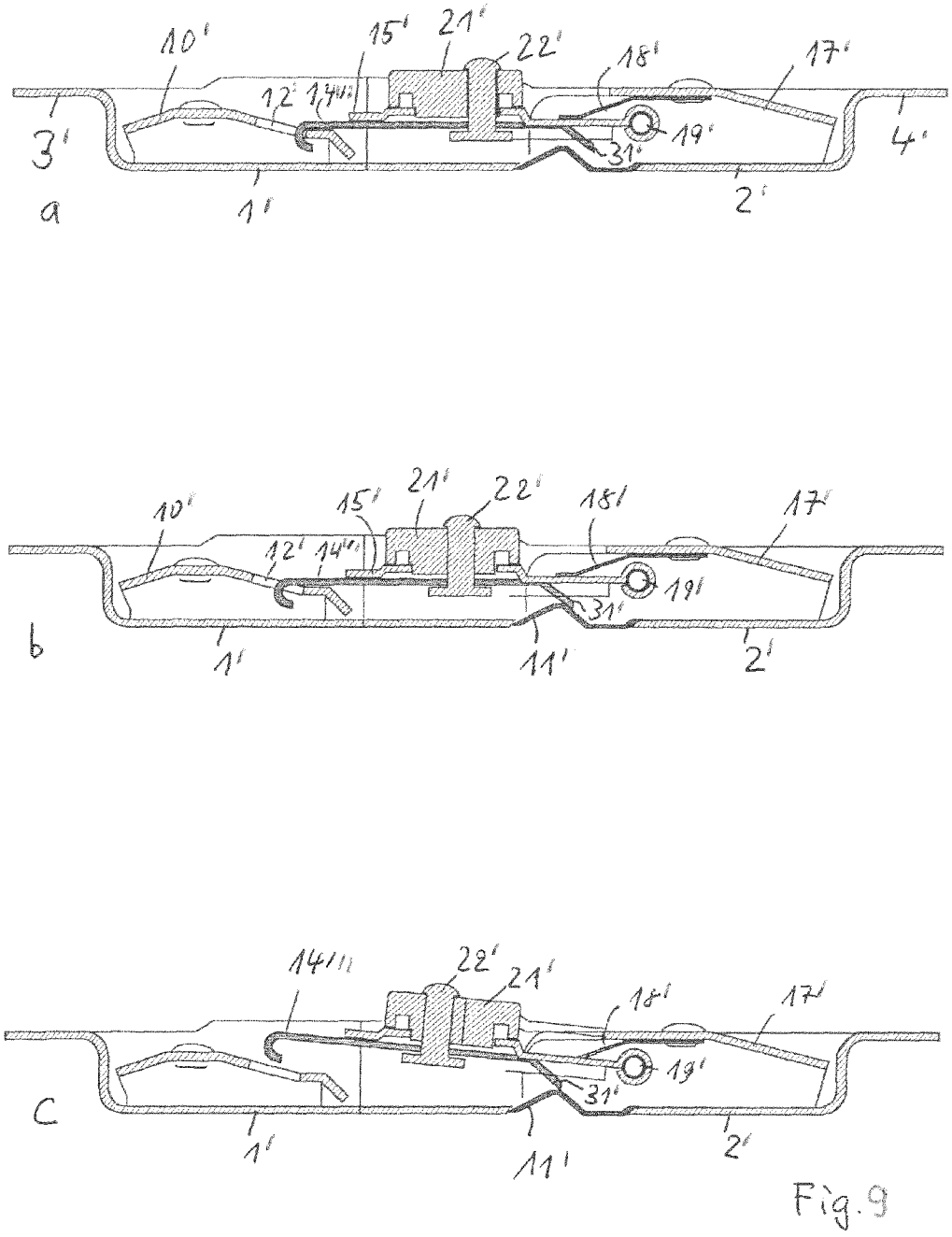
FIG. 9*a-c* show a longitudinal section through another embodiment in three positions.

FIG. 9*a* shows the closed position, FIG. 9*b* shows an intermediate position, in which the fastener hook 14' extends due to a rotation of the wing handle (not shown in FIG. 9), wherein the upstand 31 contacts the fastener hook 14". Upon a further extension of the fastener hook 14", the fastener hook 14" is lifted such that the two cups and therewith the cover and the transport container may be separated from each other (See FIG. 9*c*).

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A fastener comprising:

a first cup adapted to be arranged on one of two portions of a transport container;

a second cup adapted to be arranged on another of the two portions of the transport container, the two portions of the transport container being spaced apart in an open state and movable relative to one another when said fastener is in an unlocked state, said second cup having an embossment comprising a raised portion extending upwardly from a bottom thereof for operative engagement with a fastener hook upon closing the two portions of the transport container;

a fastener housing arranged in said first cup;

a fastener hook being displaceable and being tiltably arranged in said second cup;

a spring disposed in said second cup to bias said fastener hook toward a bottom of said second cup;

said fastener hook being displaced longitudinally toward said fastener housing upon closing the two portions of the transport container and said fastener hook contacting said fastener housing and being operatively engaged with said embossment to cause said fastener hook to tilt and to engage said fastener housing, said fastener hook engaging said fastener housing in a locked state of said fastener;

wherein said fastener hook includes a hook-shaped portion; and wherein said fastener housing includes an opening to receive said hook-shaped portion of said fastener hook in the locked state of said fastener.

2. A fastener as set forth in claim 1 including a tiltable guiding disposed in said second cup to movably support said fastener hook in a longitudinal direction.

3. A fastener as set forth in claim 2 including a housing disposed in said second cup to support said tiltable guiding.

4. A fastener comprising:

a first cup adapted to be arranged on one of two portions of a transport container;

a second cup adapted to be arranged on another of the two portions of the transport container, the two portions of the transport container being spaced apart in an open state and movable relative to one another when said fastener is in an unlocked state, said second cup having an embossment at a bottom thereof;

a fastener housing arranged in said first cup;

a displaceable fastener hook tiltably arranged in said second cup and displaceable relative to said fastener housing;

a spring disposed in said second cup to bias said fastener hook toward a bottom of said second cup;

said fastener hook being displaced longitudinally toward said fastener housing upon closing the two portions of the transport container and said fastener hook contacting said fastener housing and being operatively engaged with said embossment to cause said fastener hook to tilt and to engage said fastener housing, said fastener hook engaging said fastener housing in a locked state of said fastener;

a tiltable guiding disposed in said second cup to movably support said fastener hook in a longitudinal direction; and wherein said housing of said second cup includes at least one further spring disposed in said second cup and supported by said housing and cooperating with said tiltable guiding to serve as an axis for said tiltable guiding.

5. A fastener as set forth in claim 4 wherein said at least one further spring has a spring force larger than a spring force applied by said spring to said fastener hook.

6. A fastener as set forth in claim 1 including an eccentric disposed under said fastener hook and co-operating with said embossment at the bottom of said second cup.

7. A fastener as set forth in claim 6 including a rotatable bolt connected to said eccentric to rotate said eccentric.

8. A fastener as set forth in claim 7 including a wing handle cooperating with said bolt to rotate said bolt.

9. A fastener comprising:

a first cup adapted to be arranged on one of two portions of a transport container;

a second cup adapted to be arranged on another of the two portions of the transport container, the two portions of the transport container being spaced apart in an open state and movable relative to one another when said fastener is in an unlocked state, said second cup having an embossment at a bottom thereof;

a fastener housing arranged in said first cup;

a displaceable fastener hook tiltably arranged in said second cup and displaceable relative to said fastener housing;

a spring disposed in said second cup to bias said fastener hook toward a bottom of said second cup;

a lifter disposed under said fastener hook and co-operating with said embossment at the bottom of said second cup, wherein said fastener hook is displaced longitudinally toward said fastener housing upon closing the two portions of the transport container and said lifter engages said embossment and causing said fastener hook to tilt and be lifted from a locked state for opening said fastener and lowered into the locked state for closing same such that said spring causes said fastener hook to maintain contact with said fastener flange in the locked state.

10. A fastener as set forth in claim 9 wherein said lifter comprises an eccentric.

11. A fastener as set forth in claim 10 wherein said eccentric has a shape of a spherical calotte.

12. A fastener as set forth in claim 10 including a rotatable bolt connected to said eccentric to rotate said eccentric.

13. A fastener as set forth in claim 12 wherein said bolt has recesses therein.

14. A fastener as set forth in claim 13 including a wing handle cooperating with said bolt to rotate said bolt.

15. A fastener as set forth in claim 14 wherein said wing handle has cams engaging into said recesses in said bolt.

16. A fastener as set forth in claim 9 wherein said fastener housing includes an opening to receive a portion of said fastener hook in the locked state of said fastener.

17. A fastener as set forth in claim 9 wherein the embossment at the bottom of the second cup is a stamping.

18. A fastener comprising:

a first cup adapted to be arranged on one of two portions of a transport container;

a second cup adapted to be arranged on another of the two portions of the transport container, the two portions of the transport container being spaced apart in an open state and movable relative to one another when said fastener is in an unlocked state, said second cup having an embossment at a bottom thereof;

a fastener housing arranged in said first cup;

a displaceable fastener hook tiltably arranged in said second cup and displaceable relative to said fastener housing;

a spring disposed in said second cup to bias said fastener hook toward a bottom of said second cup;

an eccentric disposed under said fastener hook and cooperating with said embossment at the bottom of said second cup, a rotatable bolt connected to said eccentric to rotate said eccentric, and a wing handle cooperating with said bolt to rotate said bolt; and wherein said fastener hook is displaced longitudinally toward said fastener housing upon closing the two portions of the transport container and said eccentric engages said embossment and causes said fastener hook to tilt and be lifted from a locked state for opening said fastener and lowered into the locked state for closing same such that said spring causes said fastener hook to maintain contact with said fastener housing in the locked state.

* * * * *